US005364514A

United States Patent [19]

Sanborn et al.

[11] Patent Number: 5,364,514

[45] Date of Patent: Nov. 15, 1994

[54] HYDROCARBON CONVERSION PROCESS

[75] Inventors: Laura J. Sanborn, Sugar Land; Stanley N. Milam, Spring, both of Tex.; Woodrow K. Shiflett, Alta Loma, Calif.

[73] Assignee: Shell Oil Company, Houston, Tex.

[21] Appl. No.: 46,537

[22] Filed: Apr. 13, 1993

Related U.S. Application Data

[63] Continuation-in-part of Ser. No. 868,611, Apr. 14, 1992, abandoned.

[51] Int. Cl.[5] ..... C10G 37/06; C10G 23/04

[52] U.S. Cl. ..... 208/58; 208/78

[58] Field of Search ..... 208/58, 78

[56] References Cited

U.S. PATENT DOCUMENTS

| | | | |
|---|---|---|---|
| Re. 27,857 | 1/1974 | Helfrey et al. | 208/111 |
| 3,123,091 | 5/1964 | Yound | 208/111 |
| 3,132,089 | 5/1964 | Hass et al. | 208/89 |
| 3,132,090 | 5/1964 | Helfrey et al. | 208/111 |
| 3,172,835 | 3/1965 | Scott, Jr. | 208/58 |
| 3,592,757 | 7/1971 | Baral | 208/58 |
| 3,655,551 | 4/1972 | Hass et al. | 208/59 |
| 3,870,622 | 3/1975 | Ashton et al. | 208/93 |
| 3,923,636 | 12/1975 | Mead et al. | 208/58 |
| 4,960,505 | 10/1990 | Minderhoud et al. | 208/143 |
| 5,007,998 | 4/1991 | Gruia | 208/58 |
| 5,013,422 | 5/1991 | Absil et al. | 208/27 |
| 5,026,472 | 6/1991 | Hoehn et al. | 208/58 |

*Primary Examiner*—Helane Myers

*Attorney, Agent, or Firm*—Pamela J. McCollough

[57] ABSTRACT

This invention provides an integrated process for converting a hydrocarbon feedstock having components boiling above 300° F. into liquid fuel products boiling in the range of from about 80° F. to about 700° F., which process comprises passing said feedstock to a first stage hydrocracking zone to effect decomposition of organic sulfur and/or nitrogen compounds, passing a portion of the product from said first stage hydrocracking zone to a second stage hydrocracking zone, simultaneously passing the remaining portion of said product from said first stage hydrocracking zone to an aromatics saturation zone, and subsequently passing the product from said hydrocracking zone and said aromatics saturation zone to one or more fractionating zones wherein said products are separated into a tops fraction and a bottoms fraction, with the tops fraction being separated into light gasoline, naphtha, jet fuel and diesel fuel products, and a portion or all of the bottoms fraction being recycled to the hydrocracking zone and/or the aromatics saturation zone following the optional removal of heavies and polynuclear aromatics.

21 Claims, 2 Drawing Sheets

FIRST STAGE HYDROCRACKING ZONE
SECOND STAGE HYDROCRACKING ZONE
AROMATICS SATURATION ZONE
FRACTIONATING ZONE
FRACTIONATING ZONE
FEED
H2
H2
H2
NH3 AND H2S
LIGHT GASOLINE
NAPHTHA
JET FUEL
DIESEL FUEL
LIGHT GASOLINE
NAPHTHA
1
2
3
4
5
6
7
8
9
10
11
12
13
14
15
16
17
18
30
31
32
33
34
35
36
37
38
39
40
41
42

HYDROCARBON CONVERSION PROCESS

This is a continuation-in-part of co-pending application Ser. No. 868,611, filed Apr. 14, 1992, now abandoned.

FIELD OF THE INVENTION

This invention relates to a catalytic hydrocracking process for upgrading hydrocarbon feedstocks to useful liquid fuel products.

BACKGROUND OF THE INVENTION

There are a large number of processes for hydrocracking petroleum hydrocarbon feedstocks and numerous catalysts which are used in these processes. Many of these processes comprise two stages, a feed preparation stage and a hydrocracking stage, with the two stages being operated with different catalysts. The first stage, in general, contains a hydrodenitrification/-hydrodesulfurization catalyst which also may include a hydrocracking function for low conversion hydrocracking, and the second stage contains a hydrocracking catalyst. Product from the first stage may be treated to remove ammonia and hydrogen sulfide gases prior to being passed to the second stage, or product may be passed directly to the second stage hydrocracker.

Recent years have witnessed substantial growth in the application of these catalytic hydrocracking processes. Initially, the desired product from such hydrocracking processes was gasoline, and it was found at an early stage that a desirable high quality naphtha product could be obtained by hydrocracking in a hydrogen atmosphere containing hydrogen sulfide. However, increasing demands for non-aromatic hydrocracked products such as jet fuels and diesel fuels have created somewhat of a dilemma in the design and operation of hydrocracking units, particularly where both high quality gasoline and naphtha products and a non-aromatic jet fuel and diesel fuel type products are desired. Hydrogen sulfide-free hydrocracking systems, i.e., "sweet", are desirable for maximum jet fuel quality, whereas the hydrogen sulfide-containing hydrocracking systems, i.e., "sour", are desired for maximum gasoline quality. In cases where the hydrocracking feedstock is free of sulfur, such as by virtue of a separate hydrofining operation, the problem can sometimes be solved by operating alternately sweet and sour, as disclosed in U.S. Pat. No. 3,132,090, issued on May 5, 1964, and U.S. Pat. No. 3,655,551, issued on Apr. 11, 1972.

It has now been found that high quality gasoline, naphtha, jet fuel and diesel fuel products can be simultaneously produced in a two stage hydrocracking process in which the effluent from the first stage hydrocracking zone is split into two streams, with one stream being passed to a second stage hydrocracking zone containing a hydrocracking catalyst and the other stream being passed to an aromatics saturation zone containing an aromatics saturation catalyst. The effluents from both the hydrocracking zone and the aromatics saturation zone are then passed to one or more fractionating zones in which the effluents are separated into a tops fraction from which light gasoline (i.e., a $C_5/C_6$ stream with a high isoparaffin to normal paraffin ratio), naphtha (i.e., light naphtha and heavy naphtha), jet fuel and diesel fuel products are recovered, and a bottoms fraction which may be recycled to the second stage hydrocracking zone and/or the aromatics saturation zone.

SUMMARY OF THE INVENTION

This invention provides an integrated process for converting a hydrocarbon feedstock having components boiling above 300° F. (149° C.) into liquid fuel products boiling in the range of from about 80° F. (28° C.) to about 700° F. (371° C.), which process comprises passing said feedstock in the presence of hydrogen through a first stage hydrocracking zone at an elevated temperature and pressure to effect decomposition of organic sulfur and/or nitrogen compounds contained therein with limited cracking, i.e. less than about 30%, of hydrocarbons, passing a portion of the product from said first stage hydrocracking zone to a second stage hydrocracking zone wherein said portion of the product is contacted at elevated pressure and a temperature in the range of from about 400° F. to about 1000° F. with a hydrogen source and at least one second stage hydrocracking catalyst comprising a Group VIB metal, a Group VIII metal and/or an oxide or sulfide thereof supported on a carrier having hydrocracking activity, simultaneously passing the remaining portion of said product from said first stage hydrocracking zone to an aromatics saturation zone wherein said remaining portion of the product is contacted at elevated pressure and a temperature in the range of from about 300° F. to about 700° F. with a hydrogen source and at least one aromatics saturation catalyst comprising one or more Group VIII noble metal hydrogenation component(s) supported on an amorphous or crystalline base, and subsequently passing the product from said hydrocracking zone and said aromatics saturation zone to one or more fractionating zones wherein said products are separated into a tops fraction and a bottoms fraction, with the tops fraction being separated into light gasoline, naphtha, jet fuel and diesel fuel products, and the bottoms fraction being recycled to the second stage hydrocracking zone and/or the aromatics saturation zone following the optional removal of the heavies and polynuclear aromatics.

DESCRIPTION OF THE PREFERRED EMBODIMENTS

Figure 1:
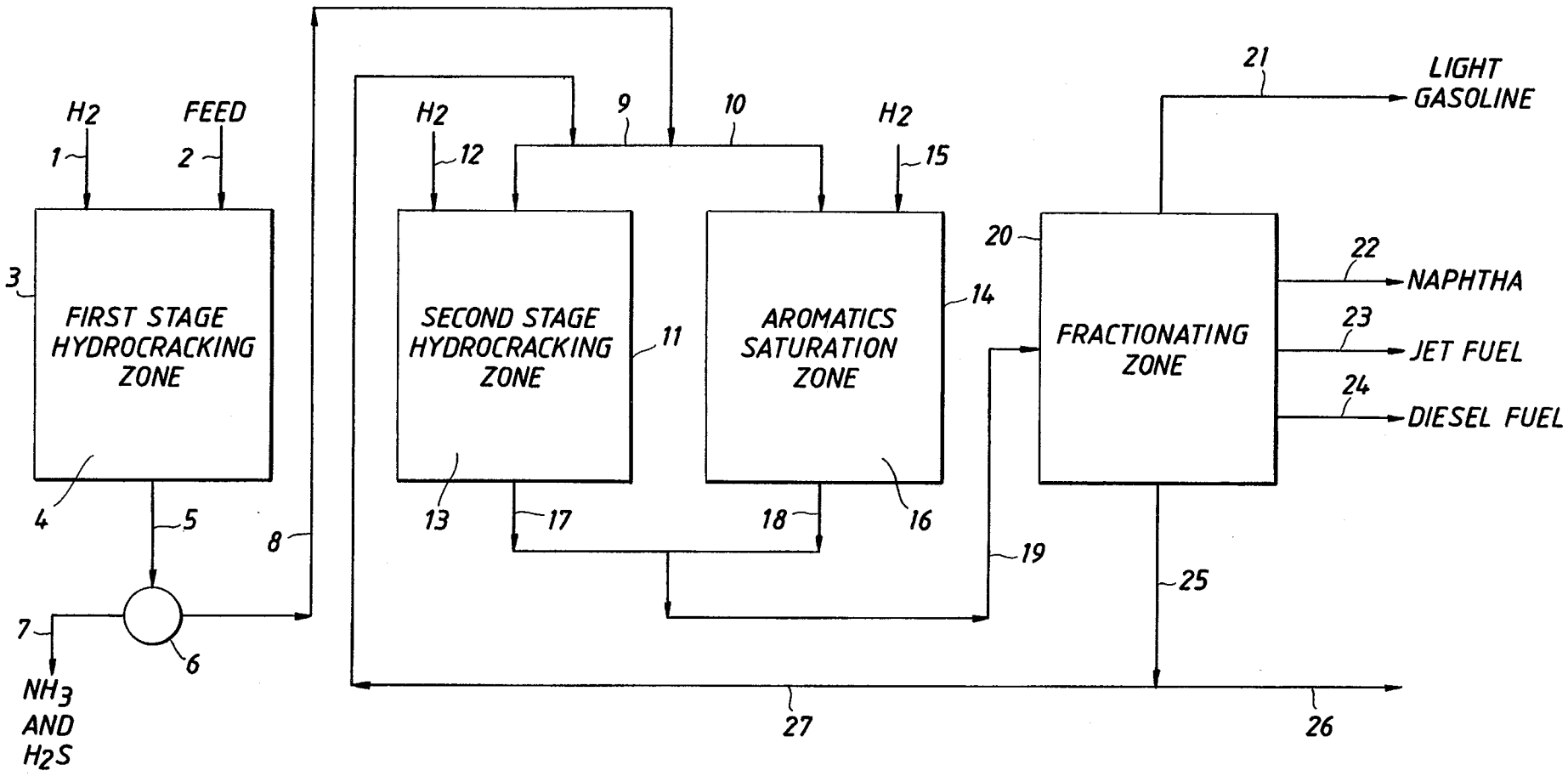
FIG. 1 illustrates one embodiment of the present process, with recycle to the second stage hydrocracking zone, in which one fractionating zone is utilized.

The hydrocarbon feedstock in the process of the present invention comprises a heavy oil fraction having a major proportion, say, greater than about fifty percent, of its components boiling above about 450° F. (232° C.), preferably above about 500° F. (260° C.) or higher. Suitable feedstocks of this type include gas oils such as atmospheric and vacuum gas oil and coker gas oil, visbreaker oil, deasphalted oil, catalytic or thermal cracker cycle oil, synthetic gas oils and coal liquids. Normally the feedstock will have an extended boiling range, e.g., up to 1100° F. (593° C.) or higher, but may be of more limited ranges with certain feedstocks. In general, the feedstocks will have a boiling range between about 300° F. (149° C.) and about 1200° F. (649° C.). Typically, the feedstock has been first subjected to a hydroprocessing step to remove nitrogen, sulfur and heavy metal impurities, prior to hydrocracking. This hydroprocessing step may also provide some degree of hydrocracking. Where the feedstock contains substantial quantities of nitrogen compounds, it is normally preferable to employ two stages of hydrocracking, and if desired, a preliminary hydrofining or hydrotreating step ahead of the first hydrocracking stage may be employed. The hydrotreating step in this instance may desirably be of the integral type where the entire hydrotreating effluent is passed directly to the first hydrocracking stage without intervening condensation or purification. Depending on the sulfur and nitrogen levels of the feedstock(s), it may be advantageous to subject the feedstocks to one or more pre-treatments to reduce the levels of sulfur and nitrogen as the best results will be obtained using feedstocks that contain rather limited amounts of sulfur and nitrogen. It is preferred that the feedstocks passed to the first stage hydrocracker in the process of the instant invention contain less than about 50,000 parts per million, generally less than about 25,000 parts per million by weight of sulfur, and less than about 4,000 parts per million, generally less than about 2,000 parts per million by weight of nitrogen.

In the process of the present invention, the desired hydrocarbon feedstock is subjected to a first stage hydrocracking zone which normally comprises a hydrotreating process, although limited cracking may also occur.

As used in this specification, "limited cracking" is used to indicate that less than about 50 percent, preferably less than about 30 percent by weight of a hydrocarbon feedstock to a given unit is converted in that unit to material boiling in a range lower than the initial boiling point of that feedstock. The initial boiling point of a hydrocarbon feedstock is measured using the procedure of ASTM D-2887. For purposes of this specification, the initial boiling point is the temperature above which about 95 percent by weight of the hydrocarbon feedstock boils. In the first stage hydrocracking zone, the hydrocarbon feedstock and a hydrogen source are contacted with at least one first stage hydrocracking catalyst. The source of hydrogen will typically be hydrogen-containing mixtures of gases which normally contain 70–90 volume percent hydrogen. Typical first stage hydrocracking catalysts include Group VIB and/or Group VIII metal compounds on an amorphous carrier such as alumina, silica-alumina, silica, zirconia or titania. Examples of such metals comprise nickel, cobalt, molybdenum and tungsten. The first stage hydrocracking catalyst is preferably an oxide and/or sulfide of a Group VIII metal, preferably cobalt or nickel, mixed with an oxide and/or a sulfide of a Group VIB metal, preferably molybdenum or tungsten, supported on alumina or silica-alumina. The catalysts are preferably in sulfided form.

Typically, the first stage hydrocracking zone is operated at temperatures in the range of from about 600° F. (316° C.) to about 800° F. (427° C.), preferably from about 650° F. (343° C.) to about 800° F. (427° C.). Pressures in the first stage hydrocracking zone are generally in the range of from about 500 psig to about 5,000 psig, preferably from about 1,000 psig to about 3,000 psig. Liquid hourly space velocities (LHSV) will typically be in the range of from about 0.3 to about 20, preferably from about 0.5 to about 5 volumes of liquid hydrocarbon per hour per volume of catalyst, and hydrogen to oil ratios will be in the range of from about 500 to about 20,000 standard cubic feet of hydrogen per barrel of feed (SCF/BBL), preferably from about 2,000 to about 12,000 SCF/BBL. These conditions are adjusted to achieve the desired degree of desulfurization and denitrification. If, for instance the feedstock has been subjected to a hydrotreating step prior to first stage hydrocracking, the organic sulfur and organic nitrogen levels may have already been reduced substantially prior to first stage hydrocracking. Typically, however, it is desirable in the first stage hydrocracking zone to reduce the organic sulfur level to below about 500 parts per million, preferably below about 200 parts per million, and the organic nitrogen level to below about 50 parts per million, preferably below about 20 parts per million.

The entire product from the first stage hydrocracking zone is necessarily passed to a means whereby gaseous ammonia and hydrogen sulfide are removed, typically by water washing, from the liquid hydrocarbon product. The liquid hydrocarbon product from the first stage hydrocracking zone is then split into two portions. Prior to being split into two portions, however, the liquid hydrocarbon product may be passed to a fractionating zone in which light gasoline and naphtha products are removed from the liquid hydrocarbon product. One portion of the liquid hydrocarbon product from the first stage hydrocracking zone is sent to a second stage hydrocracking zone and the remaining portion of the liquid hydrocarbon product from the first stage hydrocracking zone is sent to an aromatics saturation (hydrogenation) zone. The relative proportion of product from the first stage hydrocracking zone which are passed to each of these zones can vary widely and is dependent upon the types of fuel products desired. For instance, if the products desired are light gasoline and naphtha, a major portion of the feed stream, i.e., from about 50 percent by volume to about 95 percent by volume, preferably from about 75 percent by volume to about 90 percent by volume, basis the total volume of the feed stream, is sent to the second stage hydrocracking zone for processing. If, however, the desired products are jet fuels and/or diesel fuels, a major portion of the feed stream, i.e., from about 50 percent by volume to about 95 percent by volume, preferably from about 70 percent by volume to about 90 percent by volume, basis the total volume of the feed stream, is sent to the aromatics saturation zone for processing. Practically speaking, an amount of feed in the range of from about 5 percent by volume to about 95 percent by volume, preferably from about 25 percent by volume to about 75 percent by volume, basis the total volume of the feed stream, can be sent to the second stage hydrocracking zone, and from about 5 percent by volume to about 95 percent by volume, preferably from about 25 percent by volume to about 75 percent by volume, basis the total volume of the feed stream, can be sent to the aromatics saturation zone. It is understood that whatever portion of the feed from the first stage hydrocracking zone is not sent to the second stage hydrocracking zone must be sent to the aromatics saturation zone.

In the second stage hydrocracking zone, the desired portion of hydrocarbon feed stream from the first stage hydrocracking zone and a hydrogen source, typically hydrogen in admixture with other gases, are contacted with at least one second stage hydrocracking catalyst. The operating conditions normally used in the second stage hydrocracking reaction zone include a temperature in the range of from about 400° F. (204° C.) to about 1000° F. (538° C.), preferably from about 500° F.

(260° C.) to about 900° F. (482° C.), and more preferably, from about 550° F. (288° C.) to about 800° F. (427° C.), a liquid hourly space velocity (LHSV) of about 0.1 to about 10 volumes of liquid hydrocarbon per hour per volume of catalyst, preferably a LHSV of about 0.5 to about 5, and a total pressure within the range of about 500 psig to about 5,000 psig, preferably from about 1,000 psig to about 3,000 psig. The hydrogen circulation rate is generally in the range of from about 3,000 to about 15,000 standard cubic feet per barrel (SCF/BBL). These conditions are adjusted to achieve the desired conversion per pass to products boiling below the initial boiling points of the feed. Preferred per pass conversion levels to naphtha and lighter products in the second stage hydrocracking zone fall within the range of from about 50 to about 90 volume percent of the feed, preferably from about 70 to about 90 volume percent. It is understood that the severity of the operating conditions is decreased as the volume of the feed to the second stage hydrocracking zone is decreased.

The second stage hydrocracking catalysts for use in the second stage hydrocracking zone comprise an active metals component supported on a porous support having hydrocracking activity. The active metals component, "the hydrogenating component", of the second stage hydrocracking catalyst is selected from a Group VIB and/or a Group VIII metal component. From Group VIB, molybdenum, tungsten and mixtures thereof are preferred. From Group VIII, there are two preferred classes: 1) cobalt, nickel and mixtures thereof, and 2) platinum, palladium and mixtures thereof. Preferably, both Group VIB and Group VIII metals are present when cobalt and/or nickel are utilized. In a particularly preferred embodiment, the hydrogenating component is nickel and/or cobalt combined with tungsten and/or molybdenum with nickel/tungsten or nickel/molybdenum being particularly preferred. The components are typically present in the sulfide form. In general, the amounts of the various Group VIB and/or Group VIII metals which can be present in the second stage hydrocracking catalyst are set out below on an elemental basis and based on the total catalyst weight. It is understood that any one second stage hydrocracking catalyst most likely does not contain all of these metals. For example, platinum and palladium, which are typically present in the reduced metal form, are generally not used in combination with Group VIB metals, which are typically present in the sulfide form.

| | Broad | Preferred | Most Preferred |
|---|---|---|---|
| Group VIB | 1–30 | 1–20 | 2–15 |
| Group VIII | 0.05–10 | 0.1–5 | 0.5–3.5 |
| Nickel | 1–20 | 1–15 | 2–10 |
| Cobalt | 1–6 | 1–5 | 1.5–4 |
| Tungsten | 1–30 | 2–20 | 4–15 |
| Molybdenum | 1–20 | 1–15 | 2–15 |
| Platinum | 0.05–5 | 0.1–2 | 0.2–1 |
| Palladium | 0.05–5 | 0.1–2 | 0.2–1 |

The Group VIB and Group VIII metals are supported on a carrier having hydrocracking activity. Two main classes of carriers known in the art are typically utilized: (a) the porous amorphous inorganic oxide carriers selected from alumina, silica, silica-alumina, titania, zirconia and mixtures thereof and (b) the large pore molecular sieves, i.e. zeolites. Mixtures of the porous amorphous inorganic oxide carriers and the molecular sieves are also used. The term "silica-alumina" refers to non-zeolitic aluminosilicates.

Preferred supports are the large pore molecular sieves admixed with an inorganic oxide binder selected from the group consisting of alumina, silica, silica-alumina and mixtures thereof. The molecular sieves have pores greater than about 6 angstroms, preferably between about 6 to about 12 angstroms. Suitable wide pore molecular sieves are described in the book *Zeolite Molecular Sieves* by Donald W. Breck, Robert E. Krieger Publishing Co., Malabar, Fla., 1984. Suitable wide pore molecular sieves comprise the crystalline aluminosilicates, the crystalline aluminophosphates, the crystalline silicoaluminophosphates and the crystalline borosilicates. Preferred are the crystalline aluminosilicates or zeolites. The zeolites are preferably selected from the group consisting of faujasite-type and mordenite-type zeolites. Suitable examples of the faujasite-type zeolites include zeolite Y and zeolite X. Other large pore zeolites such as zeolites L, beta and omega may also be used alone or in combination with the more preferred zeolites.

The most preferred support comprises a zeolite Y, preferably an ultrastable zeolite Y (zeolite USY). The ultrastable zeolites used herein are well known to those skilled in the art. They are also exemplified in U.S. Pat. Nos. 3,293,192 and 3,449,070. They are generally prepared from sodium zeolite Y by using one or more ammonium ion exchanges followed by steam calcination. They can further be subjected to a so-called dealumination technique to reduce the amount of alumina present in the system. Dealumination techniques are described extensively in the art and comprise the use of acid extraction, the use of silicon halides or other suitable chemical treating agents, chelates as well as the use of chlorine or chlorine-containing gases at high temperatures. They will typically have low sodium contents of less than about 1 percent and will have unit cell sizes ranging from about 24.20 to about 24.60 angstroms.

The zeolite is composited with an binder selected from alumina, silica, silica-alumina and mixtures thereof. Preferably the binder is alumina, preferably a gamma alumina binder or a precursor thereto, such as an alumina hydrogel, aluminum trihydroxide or aluminum oxyhydroxide.

Two classes of zeolite-containing supports are typically used: (a) those containing a small amount of zeolite and a large amount of "binder", that is, alumina, silica, silica-alumina and mixtures thereof, and (b) large amounts of zeolite and small amounts of binder.

The low zeolite-containing support will contain from about 1 to about 50, preferably from about 1 to about 25, and more preferably from about 1 to about 10 percent by weight of zeolite on a calcined (dehydrated) basis of zeolite plus binder with the balance being composed of binder.

The high zeolite-containing support will contain from about 50 to about 99, preferably from about 60 to about 95, and more preferably from about 70 to about 90 percent by weight of zeolite on a calcined (dehydrated) basis of zeolite plus binder with the balance being composed of binder.

The second stage hydrocracking catalysts are prepared by traditional methods. For example, the molecular sieve and binder in the form of a hydrogel or hydrosol may be mulled together with water and an optional peptizing agent, extruded into pellets and calcined. The calcined pellets are impregnated with one or more solutions containing solubilized salts of Group VIB and Group VIII elements. Alternatively, the hydrogenating components may be mulled into the zeolite/alumina mixture prior to calcining. Impregnation and mulling may be combined as methods for incorporating the hydrogenating components.

The Group VIB/Group VIII second stage hydrocracking catalysts are preferably presulfided prior to use in the second stage hydrocracking zone. Typically, the catalysts are presulfided by heating the catalysts to elevated temperatures (e.g., 400°–750° F. (204°–399° C.)) in the presence of hydrogen and sulfur or a sulfur-containing material. In the event a Group VIII noble metal second state hydrocracking catalyst is utilized, the noble metal catalyst is reduced prior to use by heating the catalyst in the presence of a hydrogen-containing gas to temperatures between about 400° F. (204° C.) and about 800° F. (427° C.).

The portion of the hydrocarbon feed stream from the first hydrocracking zone which is not passed to the second stage hydrocracking zone is passed to the aromatics saturation (hydrogenation) zone. In the aromatics saturation zone, the desired portion of hydrocarbon feed stream from the first stage hydrocracking zone and a hydrogen source, typically hydrogen in admixture with other gases, are contacted with at least one aromatics saturation catalyst. The operating conditions of the aromatics saturation zone normally include a temperature between about 300° F. (149° C.) and about 700° F. (371° C.), in particular between about 400° F. (204° C.) and about 675° F. (347° C.), and preferably between about 450° F. (232° C.) and about 675° F. (347° C.), and a pressure in the range of from about 500 psig to about 5,000 psig, preferably in the range of from about 1,000 psig to about 3,000 psig. Space velocities between about 0.1 and about 10 volumes of liquid hydrocarbon per hour per volume of catalyst can be applied, preferably between 0.5 and 5. Hydrogen/feedstock ratios between about 3,000 and about 15,000 SCF/BBL, preferably between about 4,000 and about 12,000 SCF/BBL, can be suitably applied. It should be noted that the temperature to be applied is dependent on the nature of the feedstock to be hydrogenated and the volume of feedstock supplied to the aromatics saturation zone. Normally, a temperature will be chosen which allows substantial hydrogenation of the hydrogenatable components in the feedstock, i.e., at least about 70% of the total amount of components to be hydrogenated. It is preferable to carry out aromatics saturation under conditions which allow at least 80% conversion by hydrogenation of the hydrogenatable components, with greater than 90% converstion by hydrogenation being particularly preferred. By a proper choice of temperature and pressure for the aromatics saturation zone, more than 95% of the hydrogenatable components can be hydrogenated without causing substantial hydrocracking at the same time. It is preferred to carry out aromatics saturation at rather low temperatures which will reduce hydrocracking side reactions in any event.

The aromatics saturation catalysts to be used in the aromatics saturation (hydrogenation) zone of the present process comprise one or more Group VIII noble metal hydrogenation components supported on an amorphous support such as alumina, silica-alumina, silica, titania or zirconia, or mixtures thereof, or a crystalline support such as aluminosilicates, aluminophosphates, silicoaluminophosphates or borosilicates. Catalysts which contain a crystalline support are generally formed with an amorphous binder such as alumina, silica, or silica-alumina, with preference being given to the use of alumina. In particular, the aromatics saturation catalysts are preferably based on or supported on certain modified Y-type zeolites having a unit cell size between 24.18 and 24.35 Å, preferably between 24.20 and 24.30 Å, in particular between 24.22 and 24.28Å. It should be noted that besides the unit cell size requirements, the modified Y-type materials should also have a $SiO_2/Al_2O_3$ molar ratio of at least 25, in particular above 35 and preferably between 35 and 100. Without wishing to be bound to any particular theory, it appears that by applying the combination of a rather low unit cell size and a high $SiO_2/Al_2O_3$ molar ratio, hydrogenation appears to be the dominant process in the aromatics saturation zone with only limited hydrocracking taking place.

The zeolitic materials which can be used as starting materials to produce the catalysts to be used in the aromatics saturation or hydrogenation zone of the present invention comprise readily available Y-type zeolites such as ultra-stable Y and very ultra-stable Y which can be modified by using processes known in the art to produce the base materials having the required unit cell dimension together with the required $SiO_2/Al_2O_3$ molar ratio. Suitable modification processes comprise ion-exchange techniques followed by one or more calcination stages, optionally in the presence of steam. Normally, Y-zeolites already partially modified are subjected to a so-called dealumination technique to reduce the amount of alumina present in the system. Dealumination techniques are described extensively in the art and comprise the use of acid extraction, the use of silicon halides or other suitable chemical treating agents, chelates as well as the use of chlorine or chlorine-containing gases at high temperatures. Good results have been obtained using materials which have been subjected to one or more acid-leaching procedures, but other techniques may be applied as well.

The Group VIII noble metals suitable for use in the aromatics saturation catalyst comprise ruthenium, rhodium, palladium, osmium, iridium and platinum. Very good results have been obtained with combinations of platinum and palladium. The use of aromatics saturation catalysts containing both platinum and palladium is preferred since such catalysts allow relatively low hydrogenation temperatures. The Group VIII noble metals are suitably applied in amounts between about 0.05 percent by weight and about 3 percent by weight, basis the carrier or support material. Preferably, the amounts of noble metals used are in the range between about 0.2 percent by weight and about 2 percent by weight, basis the support material. When two noble metals are utilized, the amount of the two metals normally ranges between about 0.5 percent by weight and about 3 percent by weight, basis the support material. When platinum and palladium are used as the noble metals, normally a platinum/palladium molar ratio of 0.25–0.75 is typically utilized.

The aromatics saturation catalysts to be used in the aromatics saturation zone of the present process are suitably prepared by incorporating the desired amount of noble metal(s) into the appropriate zeolite, optionally together with a binder, by means of impregnation or ion-exchange techniques followed by drying, calcining and a reduction treatment, suitably with hydrogen-containing gas(es) to produce the noble metal(s) in the desired state. Suitable metals incorporation methods comprise impregnation of the appropriate support material with an aqueous solution of a palladium(II) and/or platinum halide, preferably palladium(II) and/or platinum chloride or palladium and/or platinum nitrate or the appropriate amine-complex.

After the liquid hydrocarbon feed from the first stage hydrocracking zone has been split into portions, and one portion of the feed from the first stage hydrocracking zone has been sent to the second stage hydrocracking zone and the remaining portion of feed from the first stage hydrocracking zone has been sent to the aromatics saturation zone, the effluents from these two zones may be combined and sent to a single fractionating zone. Alternatively, the respective effluents from each of these zones may be sent to more than one fractionating zone, with the effluent from the second stage hydrocracking zone being passed to one fractionating zone and the effluent from the aromatics saturation zone being sent to a separate fractionating zone.

When the effluents from the second stage hydrocracking zone and the effluent from the aromatics saturation zone are combined and passed to the same fractionating zone, the effluent is separated into a tops fraction from which is recovered a light gasoline product, a naphtha product, a jet fuel product, a diesel fuel product, and a bottoms fraction. The bottoms fraction may be removed for consumption in other processes, or alternatively, may be recycled to the second stage hydrocracking zone. As an alternative to recycling the bottoms fraction exclusively to the second stage hydrocracking zone, the bottoms fraction may be recycled to both the second stage hydrocracking zone and the aromatics saturation zone. In this recycle mode, the bottoms fraction is combined with the liquid hydrocarbon feed from the first stage hydrocracking zone prior to the splitting of the feed streams between the second stage hydrocracking zone and the aromatics saturation zone. Heavies and polynuclear aromatics may be removed from the bottoms fraction prior to recycle to the second stage processing zones.

When the effluent from the second stage hydrocracking zone and the effluent from the aromatics saturation zone are passed to separate fractionating zones, the effluent from the second stage hydrocracking zone is separated into a tops fraction from which light gasoline and naphtha products are recovered, and a bottoms fraction, and the effluent from the aromatics saturation zone is separated into a tops fraction from which light gasoline, naphtha, jet fuel and diesel products are recovered, and a bottoms fraction. The bottoms fraction from each of the respective fractionating zones may be removed for consumption in other processes, or alternatively, may be recycled to the second stage hydrocracking zone. As an alternative to recycling the bottoms fraction exclusively to the second stage hydrocracking zone, the bottoms fraction may be combined with the liquid hydrocarbon feed from the first stage hydrocracking zone prior to the splitting of the feed streams between the second stage hydrocracking zone and the aromatics saturation zone and recycled to both the second stage hydrocracking zone and the aromatics saturation zone. Heavies and polynuclear aromatics may be removed from the bottoms fractions of the fractionating zones prior to recycle to the second stage processing zones.

The process according to the present invention may be carried out in any suitable equipment. The various zones in the present invention typically comprise one or more vertical reactors containing at least one catalyst bed and are equipped with a means of injecting a hydrogen source into the reactors. A fixed bed reactor system wherein the feedstock is passed over one or more stationary beds of catalyst in each particular zone is preferred.

The ranges and limitations provided in the instant specification and claims are those which are believed to particularly point out and distinctly claim the instant invention. It is, however, understood that other ranges and limitations that perform substantially the same function in substantially the same manner to obtain the same or substantially the same result are intended to be within the scope of the instant invention as defined by the instant specification and claims.

DETAILED DESCRIPTION OF THE DRAWINGS

Figure 2:
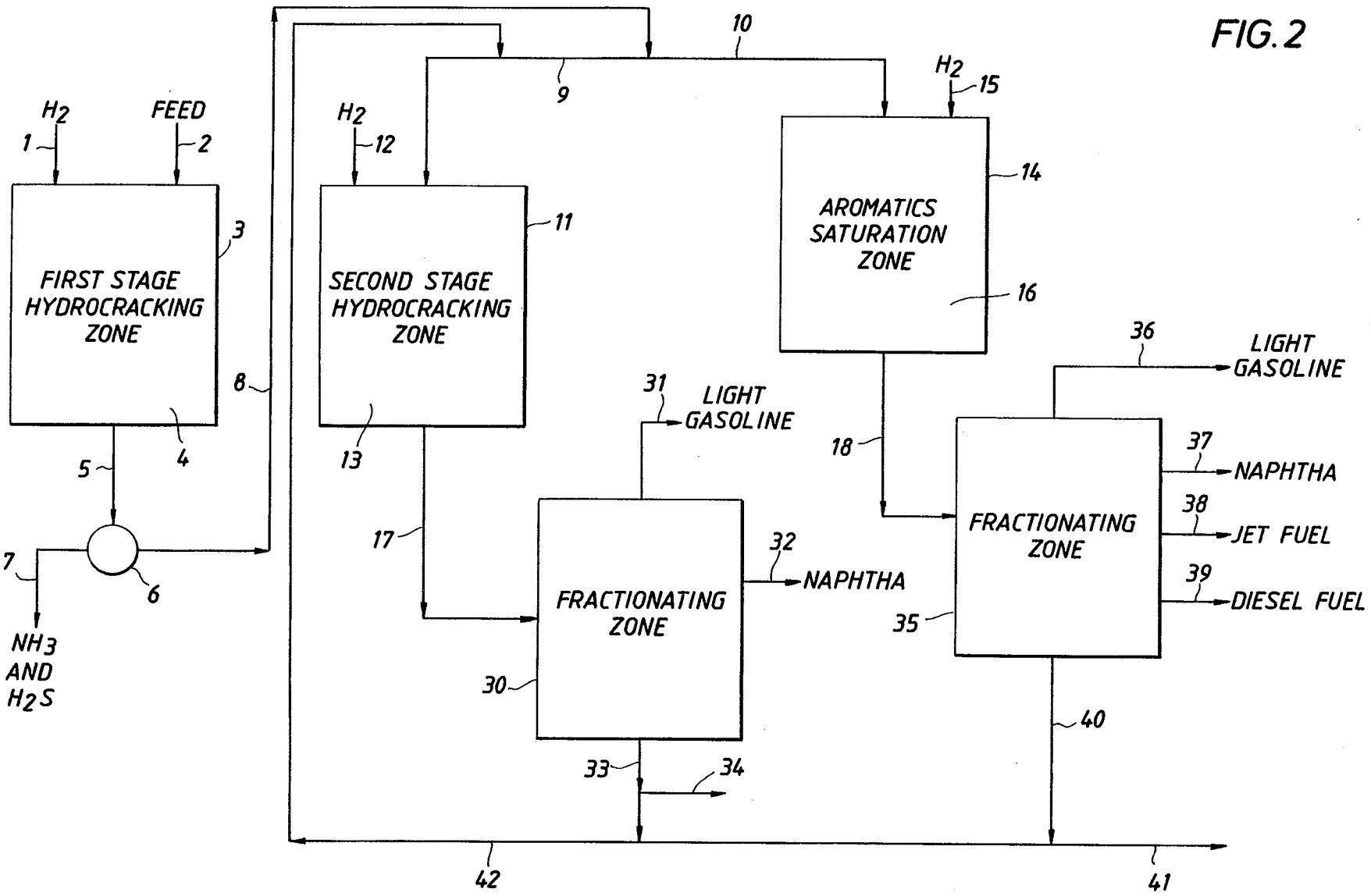
FIG. 2 illustrates another embodiment of the present process, with recycle to the second stage hydrocracking zone in which more than one fractionating zone is utilized.

For a more detailed description of the invention, reference is made to the attached drawings, FIGS. 1 and 2, which are simplified flow sheets illustrating particular embodiments of the invention.

In FIG. 1, hydrocarbon feedstock via line 2 and hydrogen via line 1 are passed into first stage hydrocracking zone 3. The first stage hydrocracking catalyst 4 in first stage hydrocracking zone 3 may comprise any of the oxides and/or sulfides of the transition metals. The first stage hydrocracking catalyst 4 is preferably an oxide and/or sulfide of a Group VIII metal, preferably cobalt or nickel, mixed with an oxide and/or a sulfide of a Group VIB metal, preferably molybdenum or tungsten, supported on a inorganic oxide support. Suitable inorganic oxide supports include alumina, silica, silica-alumina, zirconia and titania, with alumina being preferred.

Process conditions for first stage hydrocracking zone 3 include temperatures in the range of from about 600° F. to about 800° F., preferably from about 650° F. to about 800° F., pressures in the range of from about 500 psig to about 5,000 psig, preferably from about 1,000 psig to about 3,000 psig, liquid hourly space velocities (LHSV) in the range of from about 0.3 to about 20, preferably from about 0.5 to about 5, and hydrogen to oil ratios in the range of from about 500 to about 20,000 SCF/BBL, preferably from about 2,000 to about 12,000 SCF/BBL.

The total effluent from the first stage hydrocracking zone 3 is withdrawn via line 5 and passed a separator 6 where gaseous ammonia and hydrogen sulfide are removed through line 7 and the liquid hydrocarbon stream is withdrawn via line 8. The liquid hydrocabon stream in line 8 is then split into two streams and passed to parallel reactor zones, with a portion of the liquid hydrocarbon stream being passed through line 9 into second stage hydrocracking zone 11 and the remainder of the liquid hydrocarbon stream being passed through line 10 into aromatics saturation zone 14.

The liquid hydrocarbon stream in line 9 along with hydrogen via line 12 are passed to second stage hydrocracking zone 11 and contacted with second stage hydrocracking catalyst 13. Second stage hydrocracking catalyst 13 comprises a hydrogenating component which is a metal, oxide and/or sulfide of a Group VIB and/or a Group VIII elements of the Periodic Table supported on a porous support having hydrocracking activity.

Typical process conditions for second stage hydrocracking zone 11 include temperatures in the range of from about 400° F. to about 1000° F., preferably from about 500° F. to about 900° F., pressures in the range of from about 500 psig to about 5,000 psig, preferably from about 1,000 psig to about 3,000 psig, liquid hourly space velocities (LHSV) in the range of from about 0.1 to about 10, preferably from about 0.5 to about 5, and hydrogen to oil ratios in the range of from about 500 to about 20,000 SCF/BBL, preferably from about 4,000 to about 12,000 SCF/BBL.

The liquid hydrocarbon stream in line 10 along with hydrogen via line 15 are passed to aromatics saturation zone 14 and contacted with aromatics saturation catalyst 16. Aromatics saturation catalyst 16 comprises one or more Group VIII noble metal(s) on a porous support. The Group VIII metals which can be used in aromatics saturation zone 14 comprise ruthenium, rhodium, palladium, osmium, iridium and platinum. Preferably, aromatics saturation catalyst 16 contains palladium or a combination of platinum and palladium. Preferably, the aromatics saturation catalyst support comprises a modified Y-type zeolite having a unit cell size between 24.18 and 24.35 Å, particularly between 24.20 and 24.30 Å, and a $SiO_2/Al_2O_3$ molar ratio of at least 25.

The process conditions for aromatics saturation zone 14 typically include a temperature between about 300° F. and about 700° F., and preferably between about 400° F. and about 675° F. The pressure to be applied ranges between about 500 psig and about 5,000 psig, preferably between about 1,000 psig and about 3,000 psig. Liquid hourly space velocities between about 0.1 and about 10 can be applied, preferably between 0.5 and 5. Hydrogen/feedstock ratios between about 500 and about 20,000 SCF/BBL, preferably between about 4,000 and about 12,000 SCF/BBL can suitably be applied.

The effluent from second stage hydrocracking zone 11 is withdrawn though line 17 and the effluent from aromatics saturation zone 14 is withdrawn through line 18. The effluents from second stage hydrocracking zone 11 and from aromatics saturation zone 14 are combined in line 19 and passed to fractionating zone 20. In fractionating zone 20, the effluents from second stage hydrocracking zone 11 and from aromatics saturation zone 14 are fractionated into a light gasoline product 21, a naphtha product 22, a jet fuel product 23, a diesel fuel product 24, and a bottoms fraction which is removed through line 25. A portion or all of the polynuclear aromatics and heavies present in the bottoms fraction in line 25 may be removed from the system via line 26, with the remainder of the bottoms fraction in line 25 being recycled to second stage hydrocracking zone 11.

With respect to FIG. 2, the process is the same as that described above for FIG. 1 until the effluents are withdrawn via line 17 from second stage hydrocracking zone 11 and via line 18 from aromatics saturation zone 14. In the embodiment depicted in FIG. 2, the effluents from second stage hydrocracking zone 11 and aromatics saturation zone 14 are passed to separate fractionating zones. The effluent from second stage hydrocracking zone 11 is passed via line 17 to fractionating zone 30. In fractionating zone 30, the effluent from second stage hydrocracking zone 11 is fractionated into a tops fraction from which is recovered a light gasoline product 31 and a naphtha product 32, and a bottoms fraction which is removed via line 33. A portion or all of the polynuclear aromatics and heavies present in the bottoms fraction in line 33 may be removed from the system via line 34, with the remainder of the bottoms in line 33 being recycled via line 42 to line 9 and combined with the portion of effluent from first stage hydrocracking zone 3 being sent to second hydrocracking zone 11. The effluent from aromatics saturation zone 14 is passed via line 18 to fractionating zone 35. In fractionating zone 35, the effluent from aromatics saturation zone 14 is fractionated into a tops fraction from which is recovered a light gasoline product 36, a naphtha product 37, a jet fuel product 38, a diesel fuel product 39, and a bottoms fraction which is removed through line 40. A portion or all of the polynuclear aromatics and heavies present in the bottoms fraction in line 40 may be removed from the system via line 41, with the remainder of the bottoms fraction in line 40 being recycled via line 42 to line 9 and combined with the portion of effluent from first stage hydrocracking zone 3 being sent to second stage hydrocracking zone 11.

What is claimed is:

1. An integrated process for converting a hydrocarbon feedstock having components boiling above 300° F. into liquid fuel products boiling in the range of from about 80° F. to about 700° F., which process comprises:

a) passing said hydrocarbon feedstock in the presence of a hydrogen source and at least one first stage hydrocracking catalyst through a first stage hydrocracking zone at an elevated temperature and pressure to effect decomposition of organic sulfur and/or nitrogen compounds contained therein with limited cracking of hydrocarbons, b) passing a portion of the product from said first stage hydrocracking zone to a second stage hydrocracking zone wherein said portion of the product is contacted at elevated pressure and a temperature in the range of from about 400° F. to about 1000° F. with a hydrogen source and at least one second stage hydrocracking catalyst comprising one or more hydrogenating components selected from the group consisting of Group VIB metals, oxides, sulfides, Group VIII metals, oxides, sulfides and mixtures thereof supported on a carrier having hydrocracking activity, c) passing the remaining portion of said product from said first stage hydrocracking zone to an aromatics saturation zone wherein said remaining portion of the product is contacted at elevated pressure and a temperature in the range of from about 300° F. to about 700° F. with a hydrogen source and an aromatics saturation catalyst comprising one or more Group VIII noble metal hydrogenation components on a support selected from an amorphous support and a zeolitic support, d) passing the products from said second stage hydrocracking zone and said aromatics saturation zone to one or more fractionating zones wherein said products are separated into a tops fraction and a bottoms fraction, and e) recovering liquid fuel products boiling in the range of from about 80° F. to about 700° F. from the tops fraction.

2. The process of claim 1 wherein said first stage hydrocracking catalyst comprises a component selected from the group consisting of Group VIB metals, oxides, sulfides, Group VIII metals, oxides, sulfides and mixtures thereof, supported on an amorphous carrier.

3. The process of claim 1 wherein said first stage hydrocracking is carried out in such a way that the sulfur level of the hydrocarbon feedstock is reduced to below about 500 parts per million and the nitrogen level of the hydrocarbon feedstock is reduced to below about 50 parts per million.

4. The process of claim 3 wherein said first stage hydrocracking zone is operated at a temperature ranging from about 600° F. to about 800° F. and a pressure ranging from about 500 psig to about 5,000 psig.

5. The process of claim 1, wherein an amount of product from said first stage hydrocracking zone in the range of from about 5 percent by volume to about 95 percent by volume, basis the total volume of the product from the first stage hydrocracking zone, is sent to the second stage hydrocracking zone.

6. The process of claim 5, wherein an amount of product from said first stage hydrocracking zone in the range of from about 25 percent by volume to about 75 percent by volume, basis the total volume of the product from the first stage hydrocracking zone, is sent to the second stage hydrocracking zone.

7. The process of claim 1 wherein said second stage hydrocracking catalyst comprises a Group VIB component selected from the group consisting of tungsten, molybdenum and mixtures thereof, a Group VIII component selected from the group consisting of nickel, cobalt and mixtures thereof, and a carrier selected from molecular sieves having a pore diameter greater than about six angstroms admixed with an inorganic oxide binder selected from the group consisting of alumina, silica, silica-alumina and mixtures thereof.

8. The process of claim 7 wherein the Group VIII component is nickel, the Group VIB component is selected from the group consisting of molybdenum, tungsten and mixtures thereof, the molecular sieve is zeolite Y and the binder is alumina.

9. The process of claim 1 wherein said second stage hydrocracking zone is operated at a temperature ranging from about 500° F. to about 900° F. and a pressure ranging from about 500 psig to about 5,000 psig.

10. The process of claim 1, wherein an amount of product from said first stage hydrocracking zone in the range of from about 5 percent by volume to about 95 percent by volume, basis the total volume of the product from the first stage hydrocracking zone, is sent to the aromatics saturation zone.

11. The process of claim 10, wherein an amount of product from said first stage hydrocracking zone in the range of from about 25 percent by volume to about 75 percent by volume, basis the total volume of the product from the first stage hydrocracking zone, is sent to the aromatics saturation zone.

12. The process of claim 1 wherein said catalyst in the aromatics saturation zone comprises one or more Group VIII noble metal(s) supported on a zeolitic support comprising a modified Y zeolite having a unit cell size between 24.18 and 24.35 Å and a $SiO_2/Al_2O_3$ molar ratio of at least 25.

13. The process of claim 1 wherein said catalyst in the aromatics saturation zone comprises one or more Group VIII noble metal(s) supported on a zeolitic support comprising a modified Y zeolite having a unit cell size between 24.20 and 24.30 Å and a $SiO_2/Al_2O_3$ molar ratio of at least 25.

14. The process of claim 12 wherein said Group VIII noble metal is selected from the group consisting of palladium and mixtures of platinum and palladium.

15. The process of claim 1 wherein said aromatics saturation zone is operated at a temperature ranging from about 400° F. to about 675° F. and a pressure ranging from about 500 psig to about 5,000 psig.

16. The process of claim 1 wherein said bottoms fraction is recycled to the second stage hydrocracking zone.

17. The process of claim 1 wherein said bottoms fraction is recycled to the second stage hydrocracking zone and the aromatics saturation zone.

18. An integrated process for converting a hydrocarbon feedstock having components boiling above 300° F. into liquid fuel products boiling in the range of from about 80° F. to about 700° F., which process comprises:

a) passing said hydrocarbon feedstock in the presence of a hydrogen source and at least one first stage hydrocracking catalyst through a first stage hydrocracking zone at an elevated temperature and pressure to effect decomposition of organic sulfur and/or nitrogen compounds contained therein with limited cracking of hydrocarbons, b) passing from about 50 percent by volume to about 95 percent by volume, basis the total volume of the product from said first stage hydrocracking zone to a second stage hydrocracking zone wherein said portion of the product is contacted at elevated pressure and a temperature in the range of from about 400° F. to about 1000° F. with a hydrogen source and at least one second stage hydrocracking catalyst comprising a Group VIB component selected from the group consisting of tungsten, molybdenum and mixtures thereof, and a Group VIII component selected from the group consisting of nickel, cobalt and mixtures thereof, supported on a carrier selected from molecular sieves having a pore diameter greater than about six angstroms admixed with an inorganic oxide binder selected from the group consisting of alumina, silica, silica-alumina and mixtures thereof, c) passing the remaining portion of said product from said first stage hydrocracking zone to an aromatics saturation zone wherein said remaining portion of the product is contacted at elevated pressure and a temperature in the range of from about 300° F. to about 675° F. with a hydrogen source and at least one aromatics saturation catalyst comprising one or more Group VIII noble metal(s) supported on a zeolitic support comprising a modified Y zeolite having a unit cell size between 24.20 and 24.30 Å and a $SiO_2/Al_2O_3$ molar ratio of at least 25, d) passing the products from said second stage hydrocracking zone and said aromatics saturation zone to one or more fractionating zones wherein said products are separated into a tops fraction and a bottoms fraction, e) recovering liquid fuel products boiling in the range of from about 80° F. to about 700° F. from the tops fraction, and f) recycling the bottoms fraction.

19. The process of claim 18, wherein the amount of product from said first stage hydrocracking zone sent to the second stage hydrocracking zone is in the range of from about 75 percent by volume to about 90 percent by volume, basis the total volume of the product from the first stage hydrocracking zone.

20. An integrated process for converting a hydrocarbon feedstock having components boiling above 300° F. into liquid fuel products boiling in the range of from about 80° F. to about 700° F., which process comprises:

a) passing said hydrocarbon feedstock in the presence of a hydrogen source and at least one first stage hydrocracking catalyst through a first stage hydrocracking zone at an elevated temperature and pressure to effect decomposition of organic sulfur and/or nitrogen compounds contained therein with limited cracking of hydrocarbons, b) passing from about 50 percent by volume to about 95 percent by volume, basis the total volume of the product from said first stage hydrocracking zone to an aromatics saturation zone wherein said remaining portion of the product is contacted at elevated pressure and a temperature in the range of from about 300° F. to about 675° F. with a hydrogen source and at least one aromatics saturation catalyst comprising one or more Group VIII noble metal(s) supported on a support comprising a modified Y zeolite having a unit cell size between 24.20 and 24.30 Å and a $SiO_2/Al_2O_3$ molar ratio of at least about 25, c) passing the remaining portion of said product from said first stage hydrocracking zone to a second stage hydrocracking zone wherein said portion of the product is contacted at elevated pressure and a temperature in the range of from about 400° F. to about 1000° F. with a hydrogen source and at lease one second stage hydrocracking catalyst comprising a Group VIB component selected from the group consisting of tungsten, molybdenum and mixtures thereof, and a Group VIII component selected from the group consisting of nickel, cobalt and mixtures thereof, supported on a carrier selected from molecular sieves having a pore diameter greater than about six angstroms admixed with an inorganic oxide binder selected from the group consisting of alumina, silica, silica-alumina and mixtures thereof, d) passing the products from said second stage hydrocracking zone and said aromatics saturation zone to one or more fractionating zones wherein said products are separated into a tops fraction and a bottoms fraction, e) recovering liquid fuel products boiling in the range of from about 80° F. to about 700° F. from the tops fraction, and f) recycling the bottoms fraction.

21. The process of claim 20, wherein the amount of product from said first stage hydrocracking zone sent to the aromatics saturation zone is in the range of from about 70 percent by volume to about 90 percent by volume, basis the total volume of the product from the first stage hydrocracking zone.

* * * * *